US011950692B1

(12) United States Patent
Tsaran

(10) Patent No.: US 11,950,692 B1
(45) Date of Patent: Apr. 9, 2024

(54) ORGANIZER

(71) Applicant: Valentyn Tsaran, Kyiv (UA)

(72) Inventor: Valentyn Tsaran, Kyiv (UA)

( * ) Notice: Subject to any disclaimer, the term of this patent is extended or adjusted under 35 U.S.C. 154(b) by 0 days.

(21) Appl. No.: 18/088,647

(22) Filed: Dec. 26, 2022

Related U.S. Application Data

(60) Provisional application No. 63/276,017, filed on Nov. 5, 2021.

(51) Int. Cl.
*A47B 81/00* (2006.01)
*A47B 47/00* (2006.01)

(52) U.S. Cl.
CPC ..... *A47B 81/005* (2013.01); *A47B 47/0075* (2013.01)

(58) Field of Classification Search
CPC . A47B 81/005; A47B 47/0075; A47B 47/042; F41A 23/18; F41C 33/06
See application file for complete search history.

(56) References Cited

U.S. PATENT DOCUMENTS 2,740,530 A * 4/1956 Ponder ..... F41A 23/18 89/37.04
2,877,689 A * 3/1959 Pribis ..... F41A 23/00 73/167
2,939,587 A * 6/1960 Kondziolka ..... A47B 81/005 211/64
3,031,069 A * 4/1962 Hirsch ..... F41C 33/06 211/64
3,329,278 A * 7/1967 Pachmayr ..... F41A 23/18 248/68.1
3,356,229 A * 12/1967 Rhymes, Jr. ..... A24F 9/14 211/70.3
3,361,265 A * 1/1968 Wernimont ..... A47B 81/005 248/176.1

(Continued)

FOREIGN PATENT DOCUMENTS

CA 2089432 A1 * 8/1994
WO WO-2021086894 A1 * 5/2021

*Primary Examiner* — Stanton L Krycinski

(57) ABSTRACT

An organizer includes a vertical plate configured with a plurality of holes, blind grooves, and through grooves of various shapes and sizes; a horizontal plate configured with a plurality of ledges and blind grooves of various shapes and sizes for placing and holding various items and the vertical plate; a pistol rack fixed to the horizontal plate through one groove of the plurality of blind grooves of the horizontal plate and fixed to the vertical plate through one groove of the plurality of grooves of the vertical plate.

The pistol rack includes a stand, limiting contour of which is made by a multistep polygonal path with well-defined notches and bevels, configured with a through groove and a guide groove passing through a front side of the stand; a holding bracket configured with a blind hole in an end side of the holding bracket, a through hole in a front side of the holding bracket, a first side edge, and a second side edge; a cylindrical sleeve configured with a threaded through hole radially located in its central part, fixed in the through hole of the front side of the holding bracket; a clamping screw, comprising a screw rod and a handle with ergonomic elements for a better fit to the hand when rotating the clamping screw manually.

11 Claims, 3 Drawing Sheets

(56) References Cited

U.S. PATENT DOCUMENTS 3,913,746 A * 10/1975 Burton ..... A47B 81/005 211/64
4,438,913 A * 3/1984 Hylla ..... B25H 1/00 269/296
4,449,314 A * 5/1984 Sorensen ..... F41A 23/00 221/64
5,058,302 A * 10/1991 Minneman ..... F41A 23/18 206/315.11
5,503,276 A * 4/1996 Pierce ..... A47F 5/0807 248/309.2
5,644,862 A * 7/1997 Folmer ..... F41A 23/18 42/94
6,711,845 B2 * 3/2004 Dubois ..... A47F 7/00 248/161
D587,051 S * 2/2009 Vining ..... D6/552
7,584,861 B2 * 9/2009 Werner ..... B60R 7/14 211/184
D609,516 S * 2/2010 Vining ..... D6/552
7,735,253 B2 * 6/2010 Giebel ..... F41A 23/18 42/70.11
8,727,294 B1 * 5/2014 Harms ..... F41C 33/041 224/198
8,955,697 B2 * 2/2015 Spilotro ..... A47B 81/00 D3/262
9,228,800 B2 * 1/2016 Holmes ..... F41A 23/18
9,320,378 B2 * 4/2016 Phipps ..... F16M 11/04
9,383,179 B1 * 7/2016 Spilotro ..... B65D 25/06
9,523,545 B1 * 12/2016 Weller ..... F42B 39/02
9,803,957 B2 * 10/2017 Chavira ..... F41C 33/06
10,234,235 B2 * 3/2019 Higgins ..... F41A 23/02
10,342,364 B2 * 7/2019 Buttignon ..... A47F 5/0025
10,371,478 B2 * 8/2019 Sexton ..... F41A 29/00
10,413,060 B2 * 9/2019 Chavira ..... A47B 81/005
10,697,727 B2 * 6/2020 Higgins ..... F41C 33/0209
10,993,532 B1 * 5/2021 Goldstein ..... A47B 47/042
11,445,822 B1 * 9/2022 Werner ..... A47B 81/005
11,607,039 B1 * 3/2023 Thacker ..... A47B 81/005
2005/0230334 A1 * 10/2005 MacDonald ..... B60R 7/14 211/64
2006/0027473 A1 * 2/2006 Taylor ..... A47B 81/005 42/70.11
2006/0027514 A1 * 2/2006 Carlson ..... A47B 81/005 211/72
2007/0068835 A1 * 3/2007 Buie ..... F41A 29/00 206/373
2009/0193703 A1 * 8/2009 Riley ..... F41A 23/18 42/94
2012/0005937 A1 * 1/2012 Milino ..... F41A 23/18 42/108
2015/0060378 A1 * 3/2015 Bestor ..... A47B 81/005 248/205.5
2015/0129440 A1 * 5/2015 Abascal ..... F41A 23/18 206/317
2019/0072356 A1 * 3/2019 Couie ..... F41A 23/18
2020/0054129 A1 * 2/2020 Woods ..... A47B 81/005

* cited by examiner

ORGANIZER

CROSS-REFERENCE TO RELATED APPLICATIONS

The present application claims the benefits of and priority, under 35 U.S.C. § 119(e), to U.S. Provisional Application Ser. No. 63/276,017, filed on Nov. 5, 2021, entitled "Desktop organizer with gun holder". The entire disclosure of the application listed above is hereby incorporated by reference, in its entirety, for all that it teaches and for all purposes.

TECHNICAL FIELD

The present invention relates in general to the field of gun racks. More particularly to the embodiment and/or use which is shown and described for purposes of illustration, the present invention relates to pistol racks which can be used in combination with various organizers and stands.

BACKGROUND

Various stands and organizers are an integral part of the interior of apartments, offices and other premises. On such devices, people can usually place gadgets, documents, wallets, keys, and other things. Such devices create the ability to store various things in one place in a limited space. Placing a pistol (firearm, airgun, dummy, etc.) in a conspicuous place in a room is quite popular for decorating that room. Thus, on the one hand, there is a need for engineering integration of a pistol rack into such a stand or organizer, on the other hand, ensuring the aesthetic appeal of such a design, which is also provided by an engineering approach.

From the state of the art, pistol racks have become known. For example, U.S. Pat. No. 5,644,862A describes an adjustable gun resting system for providing an adjustable compact gun rest which supports a gun while allowing the user to easily adjust the height of the gun to a comfortable shooting position preventing the user from having to bend over during operation of the gun. The device includes a gun resting base, a supporting means secured to the gun resting base, a gun holding means which supports the gun, and an adjusting means allowing a user to adjust the gun holding means for the height of the user.

U.S. Pat. No. 6,050,763A describes a hand gun sighting device. A device for assisting in the adjustment of sights for a hand gun including a base elongated in the direction of the axis of the barrel of the gun. The forward end of the base includes a pair of lateral spaced support legs, and the rear of the base includes a single vertically adjustable support leg. Adjacent the forward end is a spacer block having a bolt hole extending laterally therethrough. A clamping jaw is located adjacent each lateral side of the spacer block, with the clamping jaws having resilient foam or similar material on their inner faces. These inner faces are adapted to abut against the lateral sides of the frame of the hand gun to retain it in position and absorb recoil when the gun is fired. To move the clamping jaws into a clamping engagement with the hand gun, there is provided a bolt extending through the hole in the spacer blocks and the associated clamping jaws, with a manually operable nut threaded upon the bolt to provide a clamping force. A resilient pad is located between the clamping jaws and the rear of the base for supporting the butt of the gun and absorbing recoil. An adapter is provided for use with guns having moving frames, and includes a bridging element mounted between the jaws to act as a support for the frame of the gun.

CN105756471B discloses an intellectual gun positioner of bullet cabinet. It includes a gun rest with an accommodation slot, a gun rest seat connected to the gun rest through a corresponding guide connection device, and a corresponding stepless adjustment locator; the stepless adjustment locator includes a bitter dry guide groove The stepless adjustment positioning plate, and corresponding several ss adjustment sliders located on the back of the stepless adjustment positioning plate respectively corresponding to the guide grooves, the gun rest is guided by the stepless adjustment positioning plate, the slots and their corresponding connecting devices are correspondingly connected with the corresponding adjustment sliders.

An adjustable support device for handguns (U.S. Pat. No. 4,438,581A) includes primarily an inclined surface for handgun butt support and fine sighting adjustment, a yoked shaft within a sleeve for handgun barrel support and approximate sighting adjustment, a vertical surface for additional stability of the shooter's hand and a three point base for support of the entire device and stability upon a surface.

U.S. Pat. No. 5,933,999A discloses a gun rest that includes an arcuate elongate rocker member having a first substantially U-shaped bracket at one end thereof for supporting the barrel of the firearm and a second substantially U-shaped bracket at the other end for supporting the firearm forward of the trigger or receiver thereof, the rocker member being pivotally attached to a yoke and rotatably mounted on a vertical support member having structure thereon for attachment to a vehicle or otherwise anchored at a selected other location.

US20170088057A1 describes a handgun holding device having a baseplate and a pair of angle brackets rigidly mounted on the baseplate to rigidly engage opposite sides of the handgun's handgrip to maintain the handgun in position during cleaning or repair while allowing ready access to all regions of the handgun. Other preferred embodiments include handgun holding devices having lateral support brackets for rigidly engaging opposite sides of the handgrip, and barrel supports mounted to the baseplate to supportably engage the handgun's barrel.

U.S. Pat. No. 5,503,276A discloses a stand for storing multiple handguns that includes a base and a vertical panel perpendicular to the base. The vertical panel contains a number of slots with a follower behind the panel and studs extending through the panel to engage a threaded cavity in the follower. The stud and follower slide in the slot and are locked in place by a stop ring on the stud. The barrel of a handgun slides over the stud and the heel of the grip may rest on the base.

In general, the above-mentioned devices are independent stand-alone devices that require additional room, they are difficult to integrate, for example, into various organizers.

Further areas of applicability of the present disclosure will become apparent from the detailed description, the claims and the drawings. The detailed description and specific examples are intended for purposes of illustration only and are not intended to limit the scope of the disclosure.

SUMMARY OF THE INVENTION

The claimed technical solution aims solving a technical problem, constituting a creation of a functional, space-saving, convenient, aesthetically and ergonomically acceptable organizer providing storage for various accessories and pistols.

According to a preferred embodiment of the invention an organizer includes a vertical plate configured with a plurality of holes, blind grooves, and through grooves of various shapes and sizes; a horizontal plate configured with a plurality of ledges and blind grooves of various shapes and sizes for placing and holding various items and the vertical plate; a pistol rack fixed to the horizontal plate through one groove of the plurality of blind grooves of the horizontal plate and fixed to the vertical plate through one groove of the plurality of grooves of the vertical plate.

The pistol rack includes a stand, limiting contour of which is made by a multistep polygonal path with well-defined notches and bevels, configured with a through groove and a guide groove passing through a front side of the stand; a holding bracket configured with a blind hole in an end side of the holding bracket, a through hole in a front side of the holding bracket, a first side edge, and a second no side edge; a cylindrical sleeve configured with a threaded through hole radially located in its central part, fixed in the through hole of the front side of the holding bracket; a clamping screw, comprising a screw rod and a handle with ergonomic elements for a better fit to the hand when rotating the clamping screw manually.

The organizer may optionally include a vertical plate, a horizontal plate, a stand, and us a holding bracket made of wood.

The organizer may optionally include a vertical plate, a horizontal plate, a stand, and a holding bracket made of plastic.

The organizer may optionally include a vertical plate, a horizontal plate, a stand, a holding bracket, a clamping screw, and a cylindrical sleeve made of metall.

The organizer may optionally include a first cloth gasket fixed into the corner notch of the holding bracket.

The organizer may optionally include a room limited by the plurality of ledges of the horizontal plate made in a shape of a cavity for placing a pistol.

The organizer may optionally include a second cloth gasket fixed in the room limited by the plurality of ledges of the horizontal plate made for placing a pistol.

The organizer may optionally include a plurality of through grooves made in the horizontal plate for charging cables.

The organizer may optionally include a hook made by curved contour of the vertical plate.

The organizer may optionally include a telephone shelf fixed perpendicularly to the vertical plate into the plurality of holes configured in the vertical plate.

The organizer may optionally include a telephone shelf fixed perpendicular to the vertical plate into one groove of the plurality of grooves configured in the vertical plate.

Various other purposes and advantages of the invention will become clear from its description in the specification that follows and from the novel features particularly pointed out in the appended claims. Therefore, to the accomplishment of the objectives described above, this invention consists of the features hereinafter illustrated in the drawings, fully described in the detailed description of the preferred embodiments and particularly pointed out in the claims. However, such drawings and description disclose only some of the various ways in which the invention may be practiced.

BRIEF DESCRIPTION OF THE DRAWINGS

Other assemblies, systems, methods, apparatus, features, and advantages of the present invention will be apparent to one skilled in the art upon examination of the following figures and detailed description. Component parts shown in the drawings are not necessarily to scale, and may be exaggerated to better illustrate the important features of the present invention.

DETAILED DESCRIPTION

Certain embodiments commensurate in scope with the originally claimed subject matter are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

Figure 1:
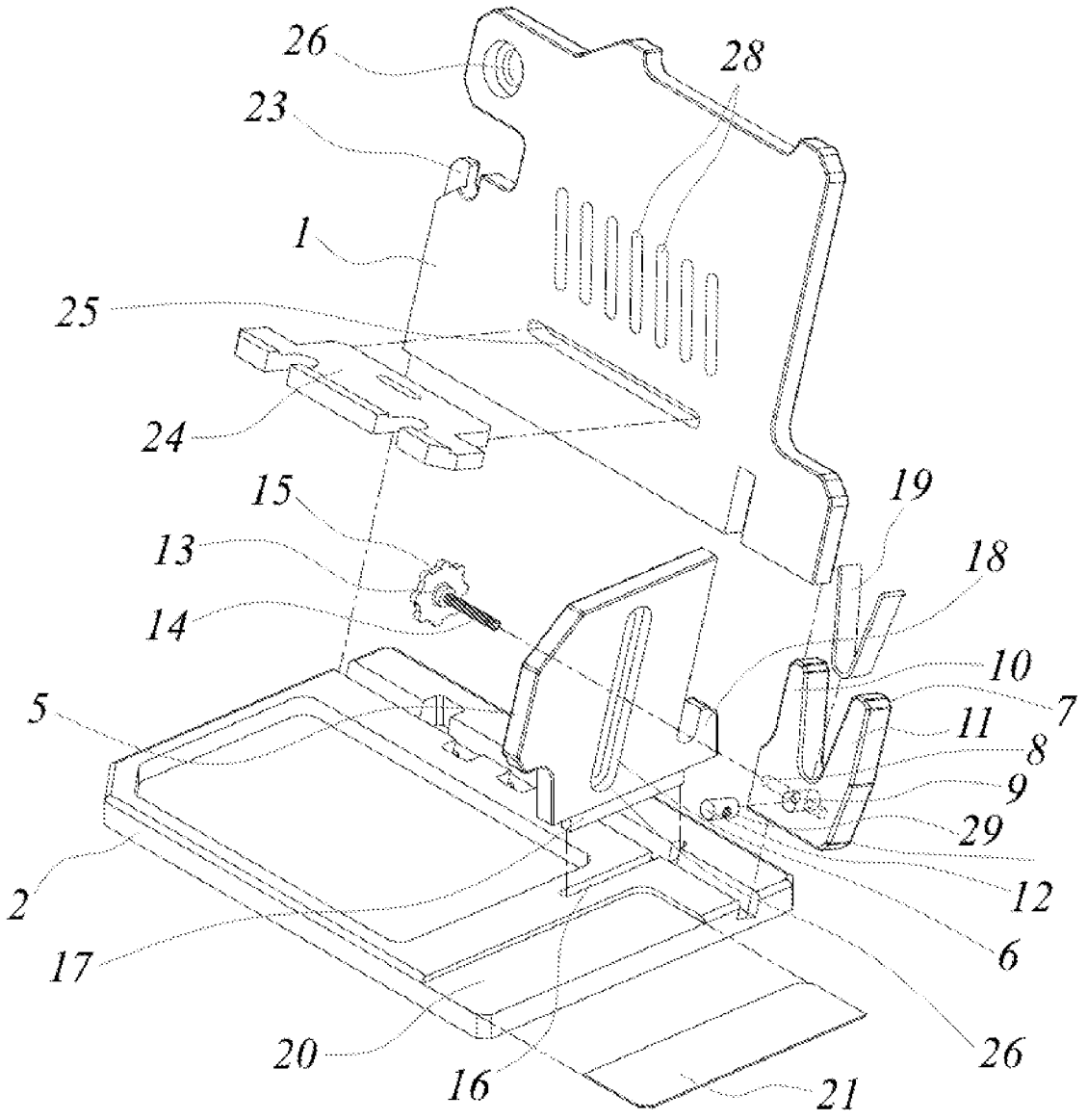
FIG. 1 is a perspective view showing front of an organizer
Figure 2:
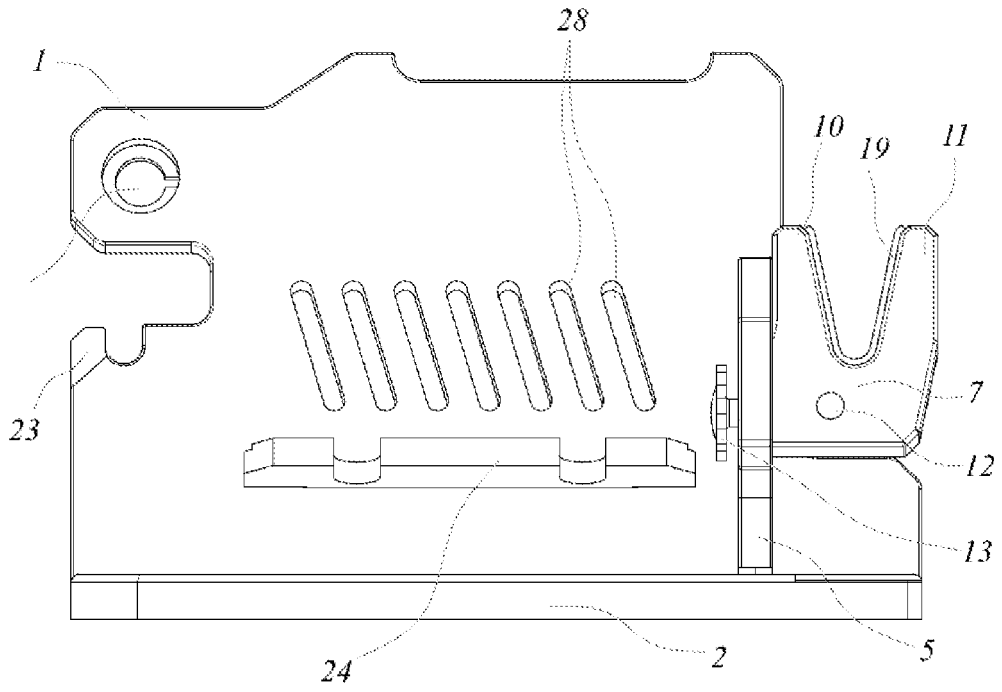
FIG. 2 is a front view of thereof.
Figure 3:
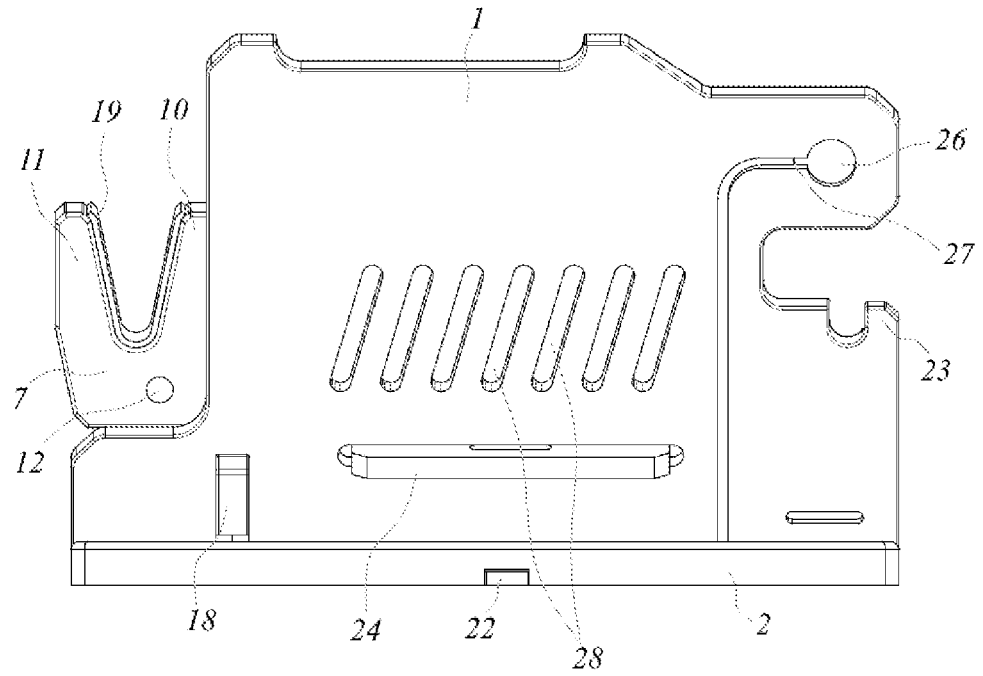
FIG. 3 is a back view thereof.
Figure 4:
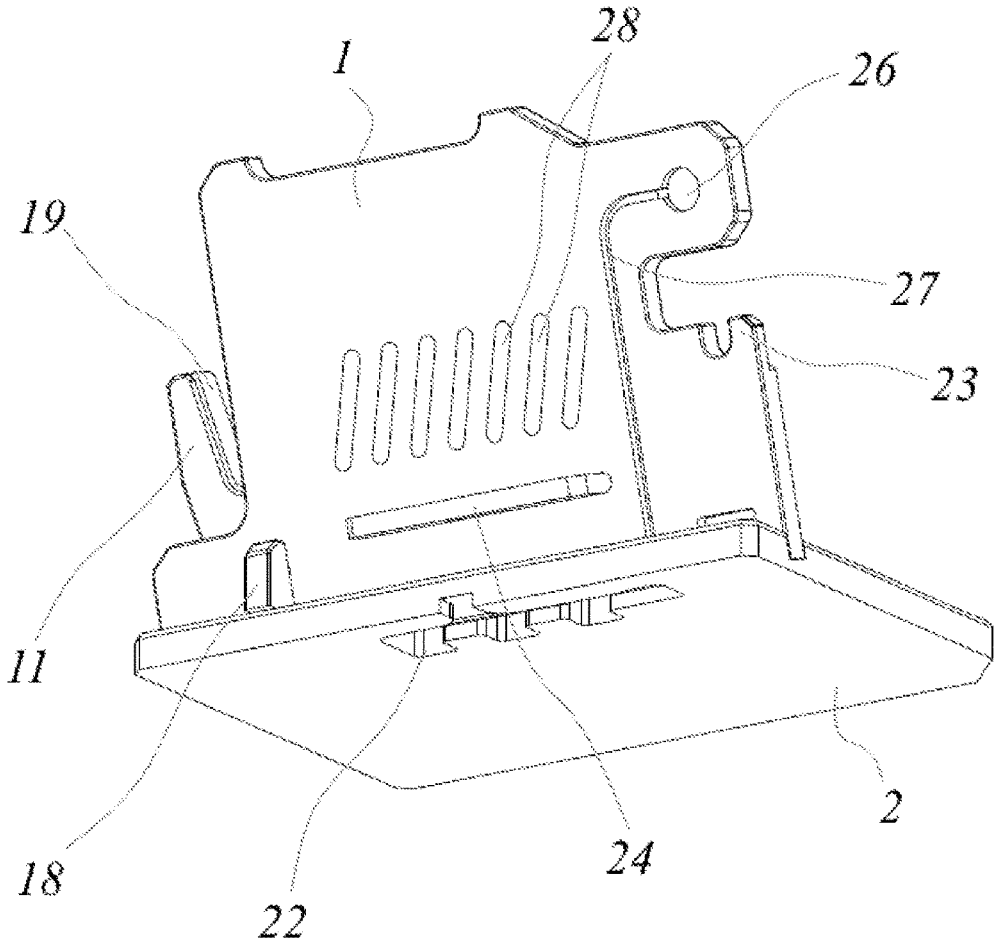
FIG. 4 is a perspective view showing back and bottom of the organizer.
Figure 5:
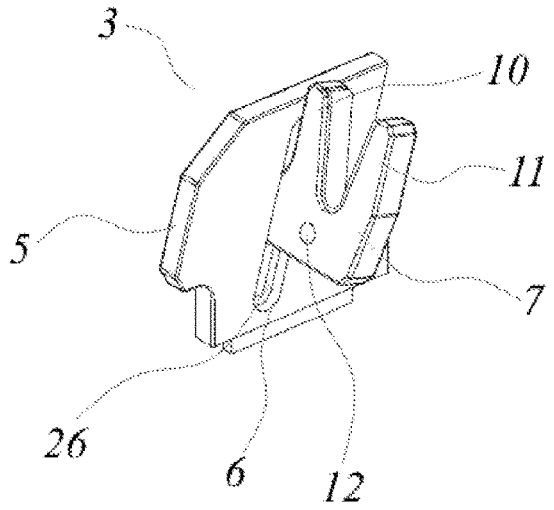
FIG. 5 is a perspective view showing a pistol rack of the organizer.

According to a preferred embodiment of the invention (FIGS. 1-6) an organizer includes a vertical plate 1 configured with a plurality of holes, blind grooves, and through grooves of various shapes and sizes; a horizontal plate 2 configured with a plurality of ledges and blind grooves of various shapes and sizes for placing and holding various items and the vertical plate 1; a pistol rack 3 fixed to the horizontal plate 2 through one groove of the plurality of blind grooves of the horizontal plate 2 and fixed to the vertical plate 1 through one groove 4 of the plurality of grooves of the vertical plate.

The pistol rack 3 includes a stand 5, limiting contour of which is made by a multistep polygonal path with well-defined notches and bevels, configured with a through groove 6 and a guide groove 26 passing through a front side of the stand 5; a holding bracket 7 configured with a blind hole 8 in an end side of the holding bracket 7, a through hole 9 in a front side of the holding bracket 7, a first side edge and a second side edge 11; a cylindrical sleeve 12 configured with a threaded through hole 29 radially located in its central part, fixed in the through hole 9 of the front side of the holding bracket 7; a clamping screw 13, comprising a screw rod 14 and a handle 15 with ergonomic elements for a better fit to the hand when rotating the clamping screw manually.

The through hole 9 in a front side of the holding bracket 7 has a diameter sufficient to accommodate and secure the cylindrical sleeve 12.

Thread diameter of the clamping screw 13 corresponds to the thread diameter of the cylindrical sleeve 12.

The stand 5 is configured to be fixed in one groove 16 of the plurality of blind grooves of the horizontal plate 2 through a guide ledge 17 of the stand 5. One end side of the stand 5 is configured to form a blind groove ledge 18 for fixing the stand 5 with a vertical plate 1. A longitudinal symmetry plane of the through groove 6 of the stand is not vertical and inclined by a certain angle, the deviation from an imaginary vertical line can be up to 450, for example. This inclination provides a more secure fixation of the holding bracket 7.

The guide ledge 17 of the stand 5, for example, can be configured with notches of equal length which are made along its entire thickness, thus the stand is fixed to the horizontal plate 2, with the help of notches and mutually perpendicular planes of the guide ledge 17, the stand 5 is positioned precisely vertically. The longitudinal movement of the stand 5 is limited by the blind groove ledge 18.

The side edges 10 and 11 are configured to converge at an acute angle forming a corner notch in the front side of the holding bracket 7.

The clamping screw 13 is configured to rotate through the through groove 6 and the guide groove 26 of the stand 5, the blind hole 8 of the holding bracket 7, and the through hole of the cylindrical sleeve connecting the stand with the holding bracket 7. The guide groove 26 serves as a guiding structural element to ensure a strictly perpendicular orientation of the holding bracket 7 in relation to the stand with the ability of correcting its position along the groove 26. The clamping screw 13 is configured to set the location of the holding bracket 7 relative to the stand 5 along the length of the through groove 6 of the stand 5 by rotating and longitudinal moving the clamping screw 13.

The organizer may optionally include a vertical plate, a horizontal plate, a stand, and a holding bracket made of wood.

The organizer may optionally include a vertical plate, a horizontal plate, a stand, and a holding bracket made of plastic.

The organizer may optionally include a vertical plate, a horizontal plate, a stand, a holding bracket, a clamping screw, and a cylindrical sleeve made of metall.

The organizer may optionally include a first cloth gasket 19 fixed into the corner notch of the holding bracket 7.

The organizer may optionally include a room limited 20 by the plurality of ledges of the horizontal plate made in a shape of a cavity for placing a pistol.

The organizer may optionally include a second cloth gasket 21 fixed in the room limited by the plurality of ledges of the horizontal plate made for placing a pistol.

The use of cloth gaskets 19 and 21 prevents scratches on the pistol.

The organizer may optionally include a plurality of through grooves 22 made in the horizontal plate for charging cables.

The organizer may optionally include a hook 23 made by curved contour of the vertical plate 1.

The organizer may optionally include a telephone shelf 24 fixed perpendicularly to the vertical plate 1 into the plurality of holes configured in the vertical plate.

The organizer may optionally include the telephone shelf 24 fixed perpendicular to the vertical plate into one groove 25 of the plurality of grooves configured in the vertical plate 1.

In the plurality of holes of the vertical plate 1 of the organizer, various chargers can be attached, watches can be built in, etc. For example, the guide groove 26 can be used as a charger slot for smart watch, a blind groove 27 can be used as a cable slot for that charger. The hook 23 can be used for holding for keys or rings. Through grooves 28 can be used for cooling gadgets, for example, smartphones which can be placed on the telephone shelf 24.

The present invention allows users apply organizer for different types and sizes of pistols. The claimed technical solution is functional, space-saving, convenient, aesthetically and ergonomically acceptable, it provides storage for various accessories and pistols in a single design.

While only certain features and embodiments of the disclosure have been illustrated and described, many modifications and changes may occur to those skilled in the art without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosed embodiments. Furthermore, in an effort to provide a concise description of the exemplary embodiments, all features of an actual implementation may not have been described. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

What is claimed is:

1. An organizer, comprising:

a vertical plate configured with a plurality of holes, blind grooves, and through grooves of various shapes and sizes;

a horizontal plate configured with a plurality of ledges and blind grooves for placing and holding the vertical plate;

a pistol rack fixed to the horizontal plate through one groove of the plurality of blind grooves of the horizontal plate and fixed to the vertical plate through one groove of the plurality of grooves of the vertical plate, the pistol rack comprising:

a stand having a limiting contour of which is made by a multistep polygonal path with a plurality of notches and bevels, the stand configured with a through groove and a guide groove passing through a front side of the stand;

wherein said stand is configured to be fixed in one groove of the plurality of blind grooves of the horizontal plate through a guide ledge of the stand;

wherein one end side of the stand is configured to form a blind groove ledge for fixing the stand with the vertical plate;

wherein a longitudinal symmetry plane of the through groove of the stand is not vertical and is inclined by an angle;

a holding bracket configured with a blind hole in an end side of the holding bracket, a through hole in a front side of the holding bracket, a first side edge, and a second side edge;

wherein said side edges are configured to converge at an acute angle forming a corner notch in the front side of the holding bracket;

a cylindrical sleeve configured with a threaded through hole radially located in a central part of the cylindrical sleeve and fixed in the through hole of the front side of the holding bracket;

a clamping screw, comprising a screw rod and a handle;

wherein the clamping screw is configured to rotate through the through groove and the guide groove of the stand, the blind hole of the holding bracket, and the through hole of the cylindrical sleeve connecting the stand with the holding bracket;

wherein the clamping screw is configured to set a location of the holding bracket relative to the stand along the length of the through groove of the stand by rotating and longitudinal moving the clamping screw.

2. The organizer of claim 1, wherein said vertical plate, horizontal plate, stand, and holding bracket are made of wood.

3. The organizer of claim 1, wherein said vertical plate, horizontal plate, stand, and holding bracket are made of plastic.

4. The organizer of claim 1, wherein said vertical plate, horizontal plate, stand, holding bracket, clamping screw, and cylindrical sleeve are made of metal.

5. The organizer of claim 1, further comprising a first cloth gasket fixed into the corner notch of the holding bracket.

6. The organizer of claim 1, further comprising a room limited by the plurality of ledges of the horizontal plate made in a shape of a cavity for placing a pistol.

7. The organizer of claim 6, further comprising a second cloth gasket fixed in the room limited by the plurality of ledges of the horizontal plate made for placing a pistol.

8. The organizer of claim 1, further comprising a plurality of through grooves made in the horizontal plate for charging cables.

9. The organizer of claim 1, further comprising a hook made by a curved contour of the vertical plate.

10. The organizer of claim 1, further comprising a telephone shelf fixed perpendicular to the vertical plate into the plurality of holes configured in the vertical plate.

11. The organizer of claim 1, further comprising a telephone shelf fixed perpendicular to the vertical plate into one groove of the plurality of grooves configured in the vertical plate.

* * * * *